United States Patent [19]

Buckle et al.

[11] Patent Number: 4,674,429

[45] Date of Patent: Jun. 23, 1987

[54] UNDERWATER BUOYANCY APPARATUS

[76] Inventors: Brian L. Buckle, 16 Sunningdale Grove, Colwyn Heights, Colwyn Bay, Clwyd, Wales; Neil C. Heesom, 152 Conway Road, Colwyn Bay, Clwyd, Wales

[21] Appl. No.: 705,658

[22] Filed: Feb. 26, 1985

Related U.S. Application Data

[63] Continuation-in-part of Ser. No. 384,917, Jun. 4, 1982, abandoned.

[30] Foreign Application Priority Data

Jun. 4, 1981 [GB] United Kingdom ..... 8117124

[51] Int. Cl.[4] ..... B63G 8/22

[52] U.S. Cl. ..... 114/333; 114/331; 114/54; 251/28; 251/63.6; 137/81.2

[58] Field of Search ..... 441/22, 96, 98; 114/54, 114/331, 332, 333; 405/186; 73/170 A, 715, 716; 244/96, 97, 99; 251/28, 63.6; 137/81.2

[56] References Cited

U.S. PATENT DOCUMENTS

| | | | |
|---|---|---|---|
| 2,887,976 | 5/1959 | Hanna et al. | 114/333 |
| 3,428,063 | 2/1969 | Plotkin et al. | 251/28 |
| 3,659,299 | 5/1972 | Davidson et al. | 114/54 |
| 3,920,033 | 11/1975 | Ferrando | 137/81.2 |
| 4,029,034 | 6/1977 | Mason | 114/333 |
| 4,218,040 | 8/1980 | Brakebill | 251/28 |

*Primary Examiner*—Sherman D. Basinger
*Assistant Examiner*—Thomas J. Brahan
*Attorney, Agent, or Firm*—Cushman, Darby & Cushman

[57] ABSTRACT

A device for venting gas from an expansible gas chamber (lifejacket, lifting bag, etc.) of an underwater buoyancy apparatus. The device comprises a monitoring device which monitors the rate of ascent of the expansible gas chamber and provides a control signal when the ascent velocity exceeds a predetermined speed. A venting valve assembly controls the venting of gas from the expansible gas chamber and is responsive to the control signal to vent gas reducing the buoyancy of the expansible gas chamber.

20 Claims, 4 Drawing Figures

UNDERWATER BUOYANCY APPARATUS

This application is a Continuation In Part of copending application Ser. No. 384,917 filed June 4, 1982, now abandoned.

BACKGROUND TO THE INVENTION

The present invention relates to underwater buoyancy apparatus of the kind having an expansible gas pocket for providing the required buoyancy, which apparatus is referred to hereinafter as "expansible buoyancy apparatus". The invention has particular, but not exclusive, application to diver's lifejackets, dry suits, and underwater lifting bags.

The buoyancy of expansible buoyancy apparatus is provided initially by admitting gas, usually air, to the gas pocket of the apparatus. In a diver's lifejacket, the gas pocket usually is constituted by a closed flexible container which is inflated by the gas. The flexible nature of the container permits of expansion of the gas within the container. Lifting bags usually comprise an open-ended flexible bag into which the gas is admitted. In some cases, the whole bag can constitute the gas pocket in similar manner to a lifejacket. However, in other vases the gas pocket can be consituted by the volume occupied by a gas defined between the bag and water contained in the bag. In the latter case, expansion of the gas pocket to displace water through the open end of the bag.

It is difficult to control the ascent of expansible buoyancy apparatus because the progressive decrease in water pressure upon ascent of the apparatus causes progressive expansion of the gas chamber and hence a progressive increase in buoyancy, which in turn causes accelerated ascent of the diver or article to which the buoyancy apparatus is attached. This is a particular problem in the case of lifting bags where acceleration of the bag and the article being lifted constitutes a significant risk to those operating the lifting bags.

A device intended to vent excess buoyancy from a lifting bag is described as part of a hover control system in U.S. Pat. No. 3,659,299 (Davidson et al.).

Davidson provides a venting valve mounted on the top of a lifting bag and intended to be opened by dynamic pressure of water caused by upward movement of the bag in water deflecting a diaphragm mechanically linked to the valve member of the venting valve. The venting valve is biassed shut by a spring of adjustable tension. In practice, the magnitude of the dynamic pressures needed to open the venting valve taught by Davidson means that the valve will not open to produce venting until the upward velocity of the bag is already excessive and the venting produced may in those circumstances not be fast enough to control the ascent. Davidson's apparatus will not in fact produce the hovering action he describes.

U.S. Pat. No. 2,887,976 describes the use of a diaphragm exposed on one side to ambient water pressures as a means of sensing static pressure and operating a venting system to maintain pressure differential between a ballast tank and ambient within a permitted range. The static pressure sensor can be used to act directly on the venting valve because the forces available are greater than when sensing the dynamic pressure produced by ascent of a lift bag or lifejacket. Of course, the role played by the static pressure sensor in the apparatus of Hanna could not be played by a dynamic pressure sensor and Hanna's apparatus could not function if a dynamic pressure sensor were used.

SUMMARY OF THE INVENTION

The present invention accordingly provides, a controlled ascent valve for underwater buoyancy apparatus which apparatus includes an expansible gas pocket, said controlled ascent valve being for venting gas from said expansible gas pocket, wherein said controlled ascent valve comprises:

means defining a supply path for pressurised gas;

means for monitoring the velocity of ascent of said underwater buoyancy apparatus, responsive to said ascent velocity to provide a control signal when said monitored velocity exceeds a predetermined value;

a pneumatically operated venting valve means comprising means defining a venting inlet for gas to the venting valve means from the eexpansible gas pocket, means defining a venting outlet from the venting valve means for gas from the expansible gas pocket, means defining a fluid communication path from said venting inlet to said venting outlet, a normally closed interrupt valve in said fluid communication path, means defining an inlet to said venting valve means from said pressurised gas supply path, and means responsive to increase in gas pressure in said supply path at said inlet to open said interrupt valve, whereby to vent gas from said expansible gas pocket to thereby reduce the buoyancy of said expansible gas pocket, and a normally closed check valve in said gas supply path adapted to open in response to said control signal, thereby to produce an increase in gas pressure at said venting valve inlet from the gas supply path to open said interrupt valve and thus to produce venting of gas from the expansible gas pocket.

Preferably, said monitoring means comprises a velocity member which in the ascent attitude of the device extends laterally of the direction of ascent and is supported for movement downwardly, said velocity member being exposed at its upper face to the ambient fluid whereby sufficiently rapid movement of the device in the ascent direction urges the velocity member downwardly.

Preferably, said velocity member comprises a flexible diaphragm supported at edge portions thereof such that sufficiently rapid movement in the ascent direction distorts said diaphragm from an at rest position by concavely deforming the upper face of said diaphragm.

Said diaphragm may be connected to a rigid actuating member which operates said check valve to release gas pressure to operate said venting valve means.

Optionally, the said check valve is a normally closed two-way poppet valve.

Such a two-way poppet valve may be located in a gas supply line and actuation of said poppet valve may cause gas flow through said gas-supply line to operate said venting valve means.

Optionally, said check valve comprises a pneumatically operated actuator means and said monitoring means comprises a exhaust valve, a gas exhaust line being connected to the pneumatic actuator, said exhaust valve being capable of venting gas from the gas exhaust line, said pneumatic actuator operating to open said check valve upon venting of said exhaust line.

Said exhaust valve may be a poppet valve.

Preferably, said pneumatic actuator comprises a pressure chamber connected to said exhaust line and containing a piston moveable in said chamber and connected to operate the check valve, said piston being biassed to a position in which said check valve is open and being urged against said bias to a position in which said check valve is closed by pressure in said chamber such that said control signal opens said gas exhaust line to exhaust gas from said pressure chamber and relieve said pressure therein, thereby opening said check valve to operate said venting valve means.

A valve of any of the kinds described may further comprise restricting means adapted to contact said diaphragm, to prevent deflecting of said diaphragm when said controlled ascent valve is tilted from its normal orientation when ascending.

Said restricting means may take the form of a movable ball.

Preferably, the monitoring means comprises means for providing a mechanical control signal when the ascent velocity exceeds said predetermined value, and a control valve operable by said mechanical signal comprising an inlet for connection to a source of pressurised gas, a chamber communicating with said inlet and containing a pneumatically displaceable valve member moveable between a closed position and an open position, said pressurised supply path for said venting valve means exiting from said chamber, said chamber defining a flow path for gas from said inlet to said gas supply path which is shut off when the valve member is in the closed position and open for gas flow from said inlet when the valve member is in the open position, a valved outlet for said chamber remote from the said inlet and normally closed by a mechanically operated valve, said mechanically operated valve being operable to open by said mechanical signal, gas bleed means providing restricted gas communication from said inlet to the valved outlet, and biassing means biassing the valve member to the closed position, whereby upon opening of the mechanically operated valve in response to said mechanical signal the valve member is displaced to the open position by gas pressure from said inlet to communicate said inlet and said gas supply path, whereby to operate said venting valve means.

Preferably, the interrupt valve of the venting valve means has a seating and a coacting valve member urged against said seating by loading, said valve member being movable against the loading away from a normal closed position of the valve by opening means accessible at the exterior of the valve.

Said opening means may be a pull-cord connected to the valve member.

Preferably, the interrupt valve of the venting valve means has a seating and a coacting valve member urged against said seating by loading, and the venting valve means includes an expansible chamber connected to said inlet from said pressurised gas supply path, said chamber being bounded by a movable wall member connected to said valve member to open the interrupt valve means upon increase of pressure in the chamber moving said wall member.

The movable wall member may be a piston movable in a cylinder.

Alternatively, the movable wall member is a flexible diaphragm.

The invention includes underwater buoyancy apparatus comprising an expansible gas pocket and a controlled ascent valve for venting gas from said expansible gas pocket wherein said controlled ascent valve comprises:

means defining a supply path for pressurised gas;

means for monitoring the velocity of ascent of said underwater buoyancy apparatus, responsive to said ascent velocity to provide a control signal when said monitored velocity exceeds a predetermined value;

a pnematically operated venting valve means comprising means defining a venting inlet for gas to the venting valve means from the expansible gas pocket, means defining a venting outlet from the venting valve means for gas from the expansible gas pocket, means defining a fluid communication path from said venting inlet to said venting outlet, a normally closed interrupt valve in said fluid communication path, means defining an inlet to said venting valve means from said pressurised gas supply path, and means responsive to increase in gas pressure in said supply path at said inlet to open said interrupt valve, whereby to vent gas from said expansible gas pocket to thereby reduce the buoyancy of said expansible gas pocket, and a normally closed check valve in said gas supply path adapted to open in response to said control signal, thereby to produce an increase in gas pressure at said venting valve inlet from the gas supply path to open said inetrrupt valve and thus to produce venting of gas from the expansible gas pocket.

The expansible gas pocket may be normally open to the ambient water or may be closed to the ambient water.

The invention also incldues a controlled ascent valve for underwater buoyancy apparatus which apparatus includes an expansible gas pocket, said controlled ascent valve serving for venting gas from said expansible gas pocket, wherein aid controlled ascent valve comprises:

monitoring means for monitoring the rate of ascent of said underwater buoyancy apparatus, said monitoring means providing a control signal when the velocity of ascent exceeds a predetermined value, said monitoring means including a flexible-walled diaphragm, said flexible-walled diaphragm having an inside surface and an outside surface being exposed to said ambient water;

a pneumatically-operated venting valve means for controlling the venting of gas from said expansible gas pocket, said venting valve means serving for venting gas from said expansible gas pocket in response to said control signal to thereby reduce the buoyancy of said expansible gas pocket; and restricting means engageable with said diaphragm, to prevent deflecting of said diaphragm when said controlled ascent valve is tilted from its normal orientation when ascending;

and wherein said control signal operates to open a normally closed gas valve and opening said gas valve causes gas to flow through a gas supply line to cause actuation of said venting valve means.

The invention further includes a controlled ascent valve for underwater buoyancy apparatus which includes an expansible gas pocket, said controlled ascent valve serving for venting gas from said expansible gas pocket, said controlled ascent valve comprising:

monitoring means for monitoring the veloctity of ascent of said underwater buoyancy apparatus, said monitoring means providing a control signal when the monitored velocity exceeds a predetermined value and comprising a flexible walled diaphragm having an inside surface and an outside surface, both said inside surface and said outside surface being exposed to said ambient water which diaphragm extends laterally in respect to the direction of the ascent of said expansible gas chamber, such that physical movement of said buoyancy aparatus toward the surface of the ambient water distorts said diaphragm from the at rest position concavely deforming said outside surface of said diaphragm; and venting valve means for controlling the venting of gas from said expansible gas pocket, said venting valve means being responsive to said control signal to vent gas from said expansible gas pocket, wherein said diaphragm is connected to a tiltable stem of a normally closed two-way poppet valve, said two-way poppet valve being located within a gas supply line, such that actuation of said two-way poppet valve by tilting of said stem causes gas to flow through said gas supply line to cause actuation of said venting valve means.

Actuation of said two-way poppet valve by tilting of said stem causes gas to flow through said gas to flow through said gas supply line to cause actuation of said venting valve means.

The following is a description, by way of example only and with reference to the accompanying drawings, of preferred embodiments of the invention.

DETAILED DESCRIPTION OF THE SHOWN EMBODIMENTS

Figure 1:
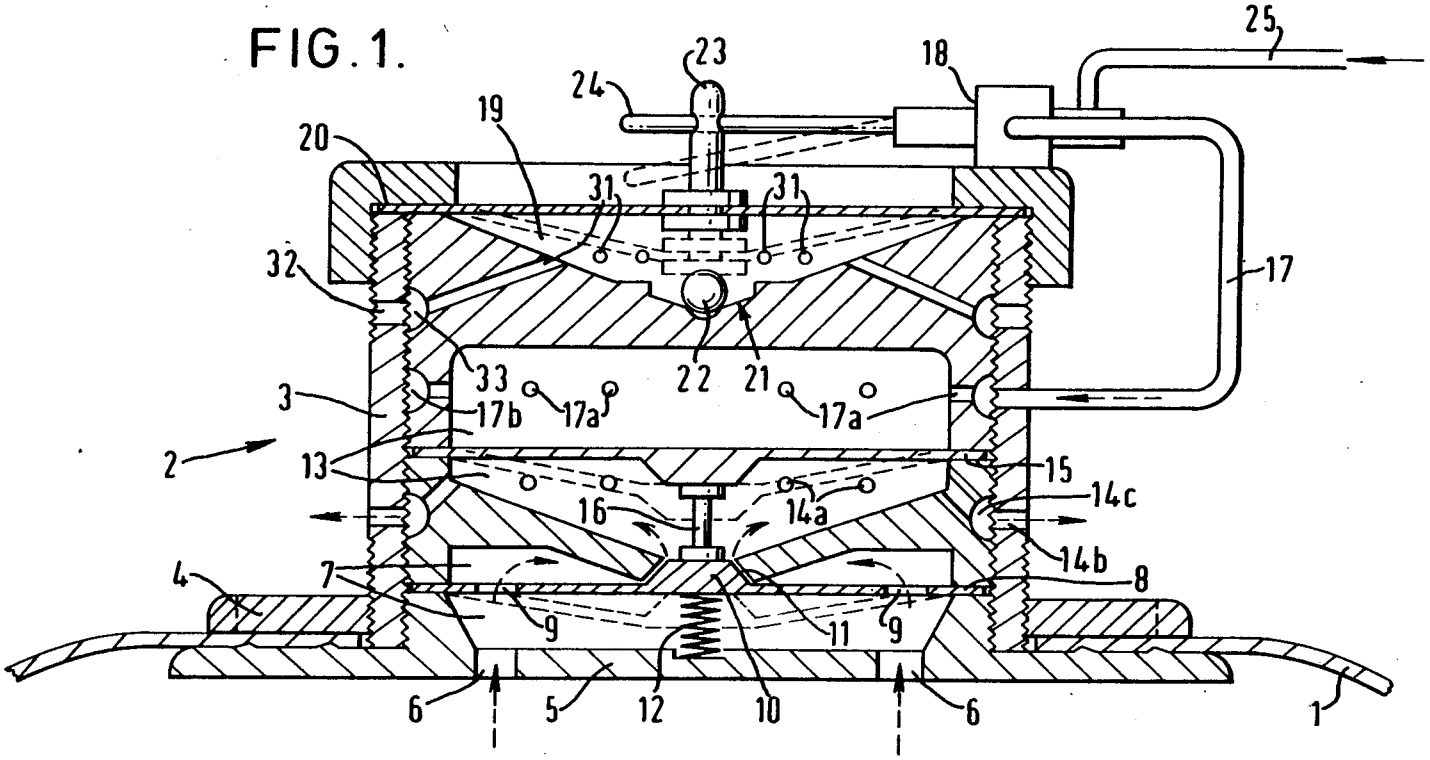
FIG. 1 is a diagrammatic cross-sectional view through a device in accordance with a first embodiment of the invnetion.

Referring first to FIG. 1, an expansible gas pocket defined for instance by a lifting bag (1) containing gas and also water is fitted with a device (2) for venting gas. The device comprises a cylindrical housing (3) which is threadably received in a circular collar (4) surrounding, in air-tight manner, a hole in the top wall of the lifting bag. The base wall (5) of the housing is provided with a venting inlet for air to the venting valve in the form of a concentric ring of holes (6) through which air can pass from the lifting bag into a lower chamber (7) across which a lower diaphragm (8) extends. the diaphragm (8) has a concentric ring of holes (9) providing gas passages therethrough. A valve closure element (10) is movable with the diaphragm to open and close a valve seat (11) arranged centrally in the upper wall of the chamber (7). Valve member (10) and seat (11) thus constitute the interrupt valve of venting valve means having an inlet at (6) for vented gas communicating via the interrupt valve with outlet (**14*c*) as described below. The diaphragm (8) and element (10) are biased upwardly by a spring (12) whereby the element (10) normally closes the seat (11**).

The seat (11) opens into an intermediate chamber (13) and the housing (3) is provided in the region of the lower part of that chamber with means defining a venting outlet constituted by circumferentially spaced holes (**14*a*,14*b*) and annular channel (14*c*) to permit egress of air from the chamber (13) valve seat 11 therefore provides with holes 9 and chamber 13 a fluid communication path from the venting inlet to the venting outlet, normally closed by said interrupt valve. An intermediate diaphragm (15) extends across the chamber (13) and is connected to the lower diaphragm (8) by a stem (16) Under the influence of spring (12), the stem (16) normally maintains the intermediate diaphragm (15) in a substantially flat configuration with the closure element (10) closing the seat (11). However, when pressure on the upper face of the intermediate diaphragm (15) is sufficient to depress the diaphragm into a concave configuration (as viewed from above), the stem (16) simultaneously moves the closure element (10) downwardly to open the seat (11). The diaphragm (15) thus provides a velocity member acting as means responsive to gas pressure introduced into the upper chamber (13) of the venting valve means and serving to open the interrupt valve (10,11**).

The chamber (13) above the diaphragm (15) is closed except for connection to an air line (17) via holes (**17*a*) and annular channel (17*b*) which constitute an inlet to the venting valve from the source of pressurized gas 25 described below. The flow of air through the line (17) is controlled by a valve (18**) in a manner to be described below.

For monitoring the velocity of ascent, the housing (3) has a recess (19) at its upper end and an upper diaphragm (20) extends across the recess. The housing below the diaphragm (20) is provided with holes (31,32) and annular channel (33) to communicate with ambient fluid. The base of recess (19) is formed with a downwardly tapered seat (21) which receives a ball (22) so that, when the device is in its ascent attitude (as shown in FIG. 1), the ball (22) rests in a depression in the center of the seat (21) and will not interfere with deflecting of the diaphragm. However, if the device is tilted, the ball (22) rolls out of the depression along the seat (21) towards the diaphragm (20) and thereby substantially reduces the extent of downward movement of the diaphragm (20).

An actuating stem (23) extends coaxially upwardly from the diaphragm (20) and is movabld therewith. The stem (23) is provided with a lateral bore through which a rigid actuating member in a form of a whisker (24) of a whisker valve (18) extends. the valve (18) is mounted on the housing (3) with the valve inlet connected to a supply path for pressurized gas, i.e. a low pressure air supply line (25) from, for example, the supply of air for intially charging the lifting bag. The arrangement is such that when the valve (18) is closed, air line (17) vents to the atmosphere, but when the valve (18) is open, air from supply line (25) passes both to atmosphere and through air line (17). Valve (18) therefore operates as check valve in the gas supply path to the venting valve means, responsive to the motion sensing diaphragm (20).

When the lifting bag (1) has been charged with air to cause it to ascend, the volume of air within the bag will increase in response to the reduced ambient water pressure. The increase in volume will cause a corresponding increase in buoyancy and hence the ascent will be accelerated. As the lifting bag ascends, the diaphragm (20) will be urged downwardly because its upper face is in direct contact with the ambient water. A velocity will be reached for which the diaphragm (20) is depressed to a sufficient extent for the actuating stem (23) to open the whisker valve (18). Air from the low pressure line (25) will then be allowed to flow through the line (17) into the chamber (13) above the diaphragm (15). The increase in pressure above the diaphragm (15) will cause the diaphragm to move downwardly thereby causing the stem (16) to move the closure element to open the seat (11). Opening of the seat (11) permits air to pass from the lifting bag through holes (6) and (9) and the seat (11) into the intermediate chamber (13) and thence through holes (14). In this manner, air is vented from the lifting bag (1) and thereby the volume of air within the lifting bag is reduced. The reduction of the volume of air within the lifting bag causes deceleration of the lifting bag to a point at which the diaphragm is permitted to return to a position where the actuating stem (23) closes the whisker valve (18). Air from above the diaphragm (15) in chamber (13) is then allowed to vent to the atmosphere through air line (17). This venting allows the diaphragms (8,15) and closure element (10) to return to their normal positions under the bias of spring (12).

Figure 2:
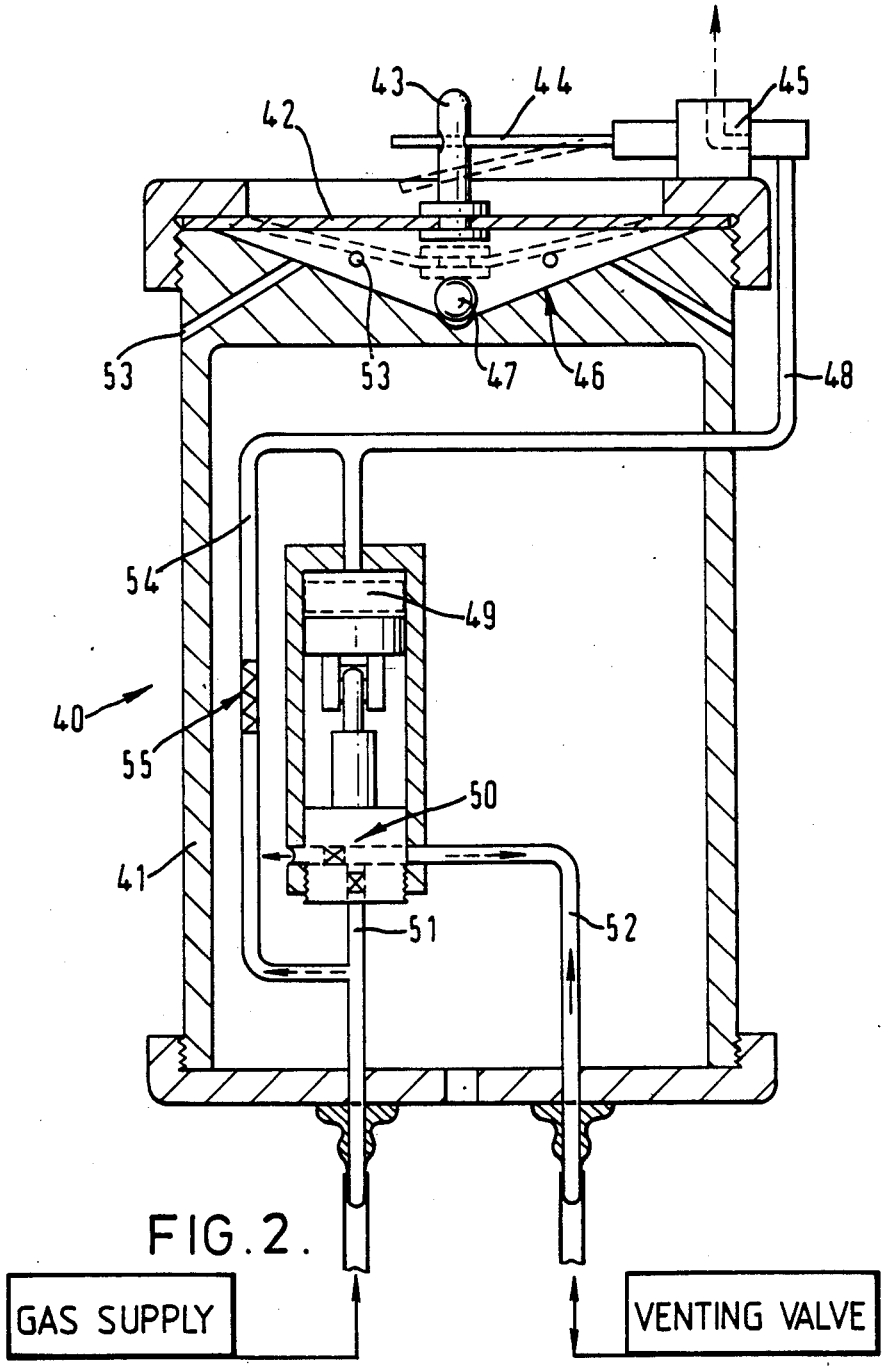
FIG. 2 is a diagrammatic cross-sectional view of a device in accordance with a second embodiment.

Referring now to FIG. 2, a device in accordance with a second embodiment of the invention is generally indicated at (4) and is attached by way of example to the side wall of a lifejacket (not shown). The device comprises an elongate housing (14) which is attached at its upper end to a diaphragm (42) serving as a velocity member for monitoring velocity of ascent. The upper face of the diaphragm (42) is in direct contact with the ambient. The diaphragm (42) has a central actuating stem (43) extending upwardly therefrom and movable therewith. The stem (43) has a lateral hole which receive reeives the whisker (44) of a whisker valve (45). The valve (45) is a normally closed two-way poppet-type whisker valve arranged to exhaust to its surroundings. The inlet is connected to an air exhaust line (48).

A tapered seat (46) and a ball (47) are provided below the diaphragm (42) in similar manner to the seat (21) and ball (22) described above with reference to FIG. 1. Circumferentially spaced holes (53) directly connect the chamber under diaphragm (42) to the ambient.

The exhaust line (48) extends from a single acting spring return pilot actuator (49) arranged to act on a normally open three-way spool valve (50) acting as a check valve in a gas supply to a venting valve. The inlet of valve (50) is connected by line (52) to a pneumatically operated venting valve connected in a gas outlet of the lifejacket. The venting valve may generally be similar to that described with reference to FIG. 1. A by-pass (54), including retrictor (55), connects the supply line (51) upstream of the valve (50) to the exhaust line (48).

In use, air supplied from the supply line (51) via the by-pass (54) maintains the actuator (49) in its extended position in which it bears against the oepating stem of valve (50) to vent the line (52). When the diaphragm (42) is moved downwardly (due to ambient dynamic pressure) in response to ascent of the device to a sufficient extent to open the whisker valve (45), air is permitted to exhaust from the actuator (49) via the exhaust line (48) so providing a control signal for the check valve 50. The piston of the actuator returns under its spring bias releasing the operating stem of the valve (50) and allowing the valve to return to its normal open condition in which it connects lines (51) and (52). The air passing through line (52) actuates the lifejacket venting valve to vent air from the lifejacket.

The venting of air from the lifejacket reduces its buoyancy and thereby decelerates ascent of a diver wearing the jacket. The diaphragm (42) will then gradually return to its normal position and thereby close the whisker valve (45). Closure of the valve will cause a build up of air pressure in the pilot acutator (49) moving the piston of that actuator to close the valve (50). Closure of the valve (50) vents the line (52) thereby reducing pressure in the lifejacket venting valve and allowing that valve to close.

Figure 3:
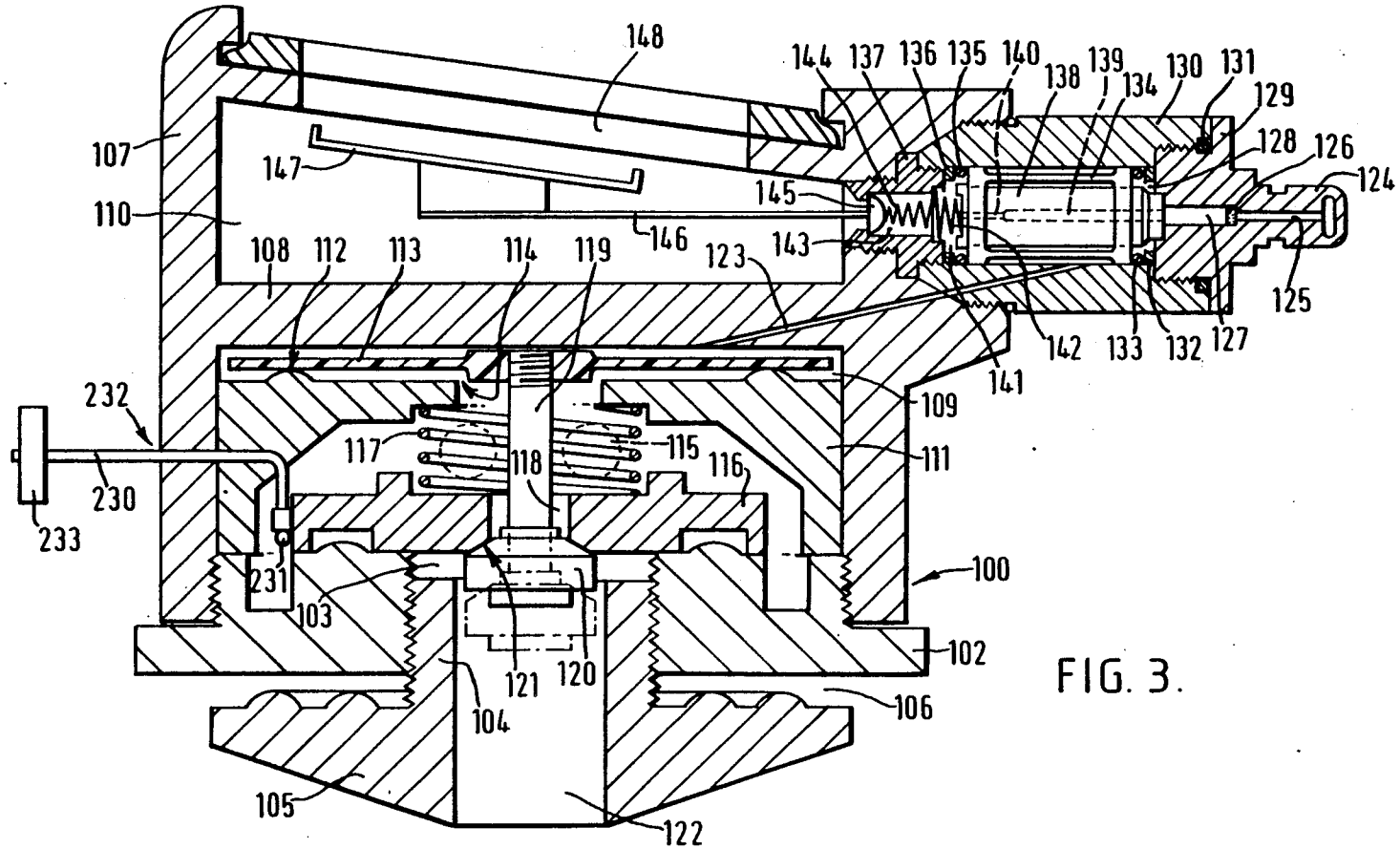
FIG. 3 is a diagrammatic cross-sectional view through a device in accordance with a third embodiment of the invention.

Referring now to FIG. 3 of the drawings, a venting device generally indicated at (100) comprises an outer body (102) having a central passage (103) which is threaded to receive a hollow stem (104) of an inner body (105). Between the outer body (102) and the inner body (105) there is defined a gap (106) into which can be introduced the neck of a lifting bag or the like (not shown). Onto the outer body (102) there is threaded a housing (107) having a transverse wall (108) which bounds a lower chamber (109) and an upper chamber (110). In the lower chamber (109) there is positioned a sealing plate (111) having an annular rib (112) on which rests a resiliently deformable diaphragm (113) acting as a movable wall member to bound chamber 109 so that it is expansible.

The upper face of the diaphragm (113) is exposed to any residual fluid pressure present in the chamber (109) so as to respond increases in gas pressure applied thereto, an the under side of the diaphragm is subject to the ambient fluid pressure, through passages (114) between the sealing plate (111) and diaphragm (113), and venting outlet holes (115) in the wall of the housing (107). In the chamber (109), below the diaphragm (113), there is disposed a seal cap (116) which is urged downwardly by a compression spring (117) so as normally to seat onto the top of the body (102). The seal cap has a wide central aperture (118) within which there is disposed with clearance a stem (119) secured to the diaphragm (113) and which carries at its lower end a valve member (120) which in the rest condition seats onto a seating (121) on the seal cap (116) and serves as an interrupt valve to prevent exit of fluid from a venting inlet passage (122) communicating with the interior of the lifting bag.

The chamber (109) communicates with an air supply controlled by check valve through a passage 123 serving as means defining a supply path for pressurised gas.

The valve has a snap-on connector (124) to receive an air hose (not shown) from an air supply. From the connector (124), an air passage (125) leads through a filter (126) and a passage (127) to a piston chamber (128). A gas passage (123) leads from piston chamber (128) to the chamber (109). The passages (125) and (127) are formed in a nut (129) threaded into a valve body (130), with an "O-ring" (131) between them. The piston chamber (128) formed in the body (130) contains a spacer washer (132) against which is seated an O-ring (133) abutted by one end of a spacer cage (134). The other end of the spacer cage abuts an O-ring (135) seated against a spacer washer (136) abutting a union (137) threaded into the body (130). Within the spacer cage (134) there is positioned a piston (138) acting as a pneumatically displaceable valve member valve member and having a first larger air passage (139) leading to a second smaller air bleed passage (140 which opens into a space (141) containing a spring (142) which thrusts the piston to the right in this drawing. The space (141) opens into a slightly smaller passage (143) serving as an outlet for the chamber 128 remote from the inlet and containing a spring (144) which acts as a biasing means to thrust a valve member (145), on one end of a rigid actuator rod (146), into a closed position. At the other end of the rod (146), there is mounted a velocity disc plate (147) for monitoring the ascent velocity.

When the mechanically operated whisker valve constituted by valve member (145) and rod (146) is closed, i.e. when the velocity member (147) is not deflected by rush of water against it, or is not deflected to a predetermined extent, the air pressures on each end of the piston (138) are balanced, and the spring (142) thrusts the piston into a closed position (to the right in this drawing) in which the piston closes off the passage (125) thus preventing pressure being applied to passage (123). If the whisker valve is opened, as a result of deflection of the velocity member (147), there is a lowering of pressure in the space (141) serving as a controlled signal, with the result that the unbalance of pressures on the piston causes it to move to the left, in this drawing, thereby opening the end of passage (125) to apply gas pressure down the passage (123) and permitting flow of air down the passage (123), to deflect the diaphragm (113) downwardly for actuation of the venting valve. As soon as deflection of the velocity member is terminated, as a result of reduction of buoyancy and thus of speed of rise in the water, the whisker valve closes again, and pressure at both ends of the piston become equalised, so that the spring (142) then returns the piston to the right and thereby closes off the passage (123).

The chamber (110) in which the velocity member (147) is positioned has an opening (148) through which the upper face of the velocity member (147) is exposed to the relative downward movement of water as the entire device rises under the effect of buoyancy. When the rate of rise exceeds a predetermined limit, the velocity member (147) permits entry of air to chamber (109). This depresses the diaphragm (113) and causes valve member (120) to be lowered away from the seating (121), thereby providing an escape path for air from the lifting bag (not shown) through the passage (122), past the seating (121), and out through the passages (115) into the ambient fluid. This escape of air from the lifting bag decreases the rate of ascent, and the force exerted on the velocity member (147) is accordingly reduced, so that the valve (145) eventually closes and the diaphragm (113) is allowed to return to its unconstrained condition as excess pressure in chamber (109) decays by slight leakage around the seal of diaphragm (113) on rib (112) and thereby lift the valve member (120) into sealing engagement with the seat (121).

To permit rapid "dumping" of air from the lifting bag, the seal cap (116) can be lifted, against the pressure of the spring (117), by pulling manually on opening means in the form of a cord (230) which is attached by a knot at (231) to the seal cap, and passes out through a hole (232), and has a handle (233) for its operation. Lifting of the seal cap (116) causes the seating (121) to be moved away from the valve member (120), so that a path for outflow of air is again provided through the passage (122) and passages (115).

Figure 4:
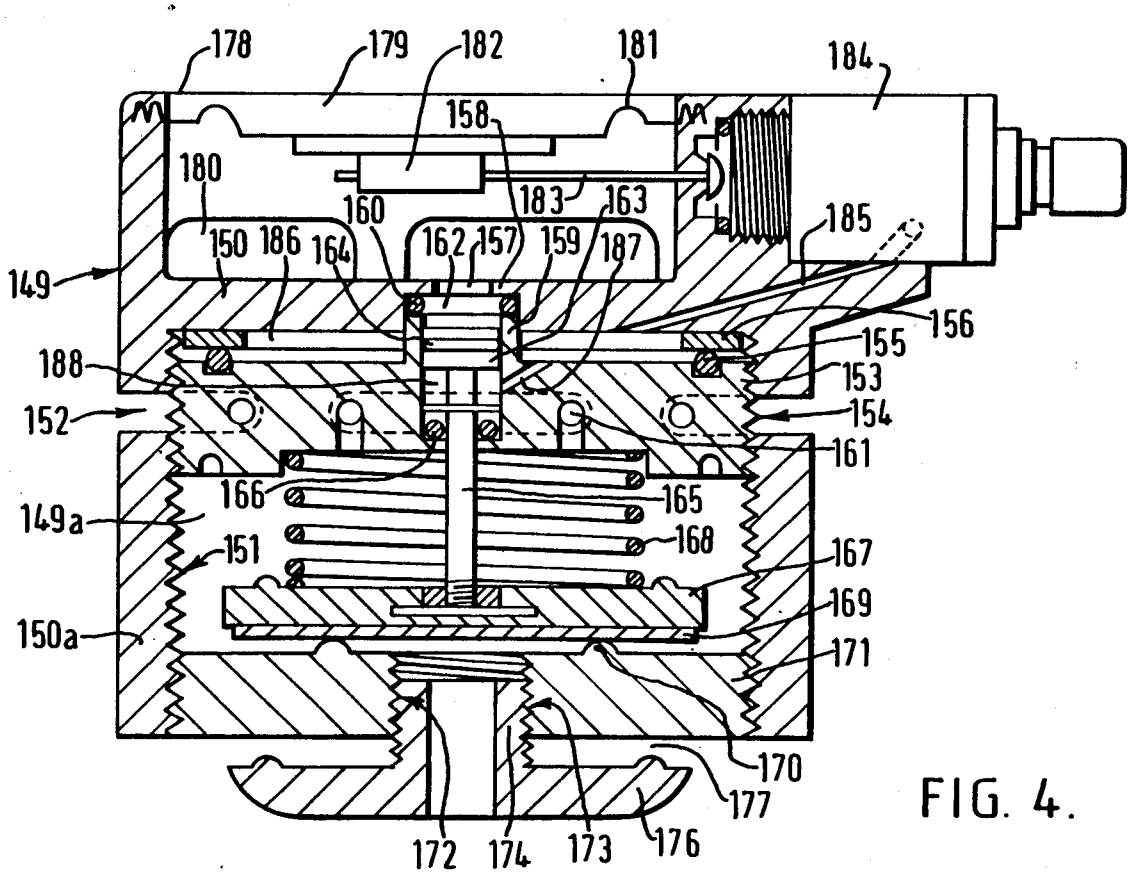
FIG. 4 is a diagrammatic cross-sectional view through a device in accordance with a fourth embodiment of the invention.

Referring now to FIG. 4 of the drawings there is shown a further embodiment of valve having a valve body (140) which is divided into upper and lower compartments by a transverse wall (150). The lower compartment (149*a*) is bounded by a wall (150*a*) having an internal threading (151), and with holes (152) to the exterior. A sealing plate (153) is threaded externally at (154) to enable it to be screwed into the lower compartment (149*a*) until an O-ring seal (155) abuts against a spacer ring (156) in the valve body (149).

The transverse wall (150) has a central opening (157) with an annular wall (158). The sealing plate (153) has a central sleeve (159) which, when the sealing plate is screwed fully home, abuts against an O-ring abutting the annular wall (158). When the sealing plate (153) is screwed fully home, passages (161) provide a communication between the underside of the sealing plate, through the holes (152), to atmosphere.

The sleeve (159) plus a portion of the body of the sealing palte (153) together bound a cylinder (162) receiving a piston (163) constituting a movable wall member and defining with the cylinder and expansible chamber. Piston 163 has a packing ring (164) and has its rod (165) passing through an O-ring (166). The lower end of the piston rod (165) is engaged with a valve member in the form of a seal cap (167) which is urged downwardly by a compression spring (168) such that a washer (169) is urged into sealing engagement with a rib (170) on an outer body (171) which is likewise threaded into the lower part of the lower compartment (149*a*). The outer body (171) has a central opening (172) which is threaed at (173) ot receive a threaded hollow stem (174) of an inner body (176) constituting a venting inlet to the valve. A gap (177) is defined between the inner body (176) and the outer body (171), and the neck of a lifting bag or the like (not shown) can be introudced into that gap and the inner body (176) tightened to provide a seal at that zone.

The interrupt valve constituted by items (169) and (170) is normally closed under the pressure of the spring (168). The upper compartment (149*b*) of the valve body (149) has a peripheral wall (178) which is inturned at its upper part to bound an opening (179), and has other openings (180) in its side portion. Across the opening (179) there is positioned an ascent velocity monitoring flexible flap or diaphragm (181) carrying centrally a velocity plate (182) mounted at the end of an actuator rod (183) of a check valve assembly here denoted generally by the reference numeral (184) but of the same construction as the valve denoted by reference numerals (124 to 145) in FIG. 3. An air flow passage (185) gas supply path, equivalent to the passage (23) in FIG. 1, leads from the valve (184) to an inlet to air space (186) which exists above the sealing plate (153) when screwed fully home. A passage (187) leads from the air space (186) to the space (188) below the piston (163).

The operation is as follows:

When the velocity of ascent is great enough to cause the velocity plate (182) to move downwards and open the valve (184), air flows through the passages (185 and 187) to space (188) and causes the piston (163) to rise, thereby lifting the seal cap (167) off the rib (170) and providing an escape path from the interior of the lifting bag (not shown) through inner body (176), outer body (171), valve (159–170), passages (161) and holes (152 to the exterior.

It is a particular advantage of this apparatus that the air pressure in the gas pocket acts so as to encourage opening of the interrupt valve constituted by member (169) and seat (170) and that because of the use of an annular rib sealing against a plate a large air flow is produced upon opening the interrupt valve with only a small movement of the valve member.

We claim:

1. A controlled ascent valve for underwater buoyancy apparatus which apparatus includes an expansible gas pocket, said controlled ascent valve being for venting gas from said expansible gas pocket, wherein said controlled ascent valve comprises:

means defining a supply path for pressurized gas;

means for monitoring the velocity of ascent of said underwater buoyancy apparatus, responsive to said ascent velocity to provide a control signal when said monitored velocity exceeds a predetermined value;

a pneumatically operated venting valve means comprising means defining a venting inlet for gas to the venting valve means from the expansible gas pocket, means defining a venting outlet from the venting valve means for gas from the expansible gas pocket, means defining a fluid communication path from said venting inlet to said venting outlet, a normally closed interrupt valve in said fluid communication path, means defining an inlet to said venting valve means from said pressurized gas supply path, and means responsive to increase in gas pressure in said supply path at said inlet to open said interrupt valve, whereby to vent gas from said expansible gas pocket to thereby reduce the buoyancy of said expansible gas pocket, and a normally closed check valve in said gas supply path adapted to open in response to said control signal, thereby to produce an increase in gas pressure at said venting valve inlet from the gas supply path to open said interrupt valve and thus to produce venting of gas from the expansible gas pocket.

2. A controlled ascent valve as defined in claim 1 wherein:

said monitoring means comprises a velocity member which in the ascent attitude of the device extends laterally of the direction of ascent and is supported for movement downwardly, said velocity member being exposed at its upper face to the ambient fluid whereby sufficiently rapid movement of the device in the ascent direction urges the velocity member downwardly.

3. A controlled ascent valve as defined in claim 2 wherein:

said velocity member comprises flexible diaphragm supported at edge portions thereof such that sufficiently rapid movement in the ascent direction distorts said diaphragm from an at rest position by concavely deforming the upper face of said diaphragm.

4. A controlled ascent valve as defined in claim 3 wherein:

said diaphragm is connected to a rigid actuating member which operates said check valve to release gas pressure to operate said venting valve means.

5. A controlled ascent valve as claimed in claim 1 wherein the said check valve is a normally closed two-way poppet valve.

6. A controlled ascent valve as claimed in claim 5 wherein two-way poppet valve is located in a gas supply line and actuation of said poppet valve causes gas flow through said gas-supply line to operate said venting valve means.

7. A controlled ascent valve as defined in claim 1 wherein:

said check valve comprises a pneumatically operated actuator means and said monitoring means comprises a exhaust valve, a gas exhaust line being connected to the pneumatic actuator said exhaust valve being capable of venting gas from the gas exhaust line, said pneumatic actuator operating to open said check valve upon venting of said exhaust line.

8. A controlled ascent valve as claimed in claim 7 wheren said exhaust valve is a poppet valve.

9. A controlled ascent valve as defined in claim 7 wherein said pneumatic actuator comprises a pressure chamber connected to said exhaust line and containing a piston moveable in said chamber and connected to operate the check valve, said piston being biassed to a position in which said check valve is open and being urged against said bias to a position in which said check valve is closed by pressure in said chamber such that said control signal opens said gas exhaust line to exhaust gas from said pressure chamber and relieve said pressure therein, thereby opening said check valve to operate said venting valve means.

10. A controlled ascent valve as defined in claim 2 further comprising:

restricting mean adapted to contact said diaphragm, to prevent deflecting of said diaphragm when said controlled ascent valve is tilted from its normal orientation when ascending.

11. A controlled ascent valve as defined in claim 10 wherein:

said restricting means takes the form of a movable ball.

12. A controlled ascent valve as claimed in claim 1 wherein the monitoring means comprises means for providing a mechanical control signal when the ascent velocity exceeds said predetermined value, and said check valve is operable by said mechanical signal and comprises an inlet for connection to a source of pressurized gas, a chamber communicating with said inlet and containing a pneumatically displaceable valve member-moveable between a closed position and an open position, said pressurised supply path for said venting valve means exiting from said chamber, said chamber defining a flow path for gas from said inlet to said gas supply path which is shut off when the valve member is in the closed position and open for gas flow from said inlet when the valve member is in the open position, avalved outlet for said chamber remote from the said inlet and normally closed by a mechanically operated valve, said mechanically operted valve being operable to open by said mechanical signal, gas bleed means providing restricted gas communication from said inlet to the valved outlet, and biassing means biassing the valve member to the closed position, whereby upon opening of thee mechanically operated valve in response to said mechanical signal the valve member is displaced to the open position by gas pressure from said inlet to communicate said inlet and said gas supply path, whereby to operate said venting valve means.

13. A controlled ascent valve as claimed in claim 1, wherein the interrupt valve of the venting valve means has a seating and a coacting valve member urged against said seatinng by loading, said valve member being movable against the loading away from a normal closed position of the valve by opening means accessible at the exterior of the valve.

14. A controlled ascent valve as claimed in claim 13, wherein said opening means is a pull-cord connected to the valve member.

15. A controlled ascent valve as claimed in claim 1 wherein the interrupt valve of the venting valve means has a seating and a coacting valve member urged against said seating by loading, and the venting valve means includes an expansible chamber connected to said inlet from said pressurised gas supply path, said chamber being bounded by a movable wall member connected to said valve member to open the interrupt valve means upon increase of pressure in the chamber moving said wall member.

16. A controlled ascent valve as claimed in claim 15 wherein the movable wall member is a piston movable in a cylinder.

17. A controlled ascent valve as claimed in claim 16 wherein the movable wall member is a flexible diaphragm.

18. Underwater buoyancy apparatus comprising an expansible gas pocket and a controlled ascent valve for venting gas from said expansible gas pocket wherein said controlled ascent valve comprises:

means defining a supply path for pressurised gas;

means for monitoring the velocity of ascent of said underwater buoyancy apparatus, responsive to said ascent velocity to provide a control signal when said monitored velocity exceeds a predetermined value;

a pneumatically operated venting valve means comprising means defining a venting inlet for gas to the venting valve means from the expansible gas pocket, means defining a venting outlet from the venting valve means for gas from the expansible gas pocket, means defining a fluid communication path from said venting inlet to said venting outlet, a normally closed interrupt valve in said fluid communication path, means defining an inlet to said venting valve means from said pressurised gas supply path, and means responsive to increase in gas pressure in said supply path at said inlet to open said interrupt valve, whereby to vent gas from said expansible gas pocket to thereby reduce the buoyancy of said expansible gas pocket, and a normally closed check valve in said gas supply path adapted to open in response to said control signal, thereby to produce an increase in gas pressure at said venting valve inlet from the gas supply path to open said interrupt valve and thus to produce venting of gas from the expansible gas pocket.

19. Underwater buoyancy apparatus as claimed in claim 18 wherein the expansible gas pocket is normally open to the ambient water.

20. Underwater buoyancy apparatus as claimed in claim 18 wherein the expansible gas pocket is closed to the ambient water.

* * * * *